US008889203B2

(12) United States Patent
York

(10) Patent No.: US 8,889,203 B2
(45) Date of Patent: Nov. 18, 2014

(54) CARTRIDGE FOR THE PREPARATION OF BEVERAGES

(75) Inventor: Geoffrey York, Wallsall (GB)

(73) Assignee: Kraft Foods R&D, Inc., Deerfield, IL (US)

( * ) Notice: Subject to any disclaimer, the term of this patent is extended or adjusted under 35 U.S.C. 154(b) by 354 days.

(21) Appl. No.: 13/501,242

(22) PCT Filed: Oct. 20, 2010

(86) PCT No.: PCT/GB2010/001953

§ 371 (c)(1),
(2), (4) Date: Apr. 10, 2012

(87) PCT Pub. No.: WO2011/048377

PCT Pub. Date: Apr. 28, 2011

(65) Prior Publication Data

US 2012/0196008 A1 Aug. 2, 2012

(30) Foreign Application Priority Data

Oct. 22, 2009 (GB) ..... 0918575.2

(51) Int. Cl.
*B65B 29/02* (2006.01)
*B65D 85/804* (2006.01)

(52) U.S. Cl.
CPC ..... *B65D 85/8043* (2013.01)
USPC ..... 426/79; 426/77; 426/474; 99/295

(58) Field of Classification Search
CPC ..... B65D 85/8043
USPC ..... 426/77, 79, 112, 474; 99/295
See application file for complete search history.

(56) References Cited

FOREIGN PATENT DOCUMENTS

| | | |
|---|---|---|
| EP | 1716055 B1 | 11/2006 |
| GB | 2454656 A | 5/2009 |
| WO | 0158786 A1 | 8/2001 |

OTHER PUBLICATIONS

International Search Report and Written Opinion dated Mar. 16, 2011 for PCT/GB2010/001953 (12 pgs.).
Claims dated Nov. 9, 2009 for GB0918575.2 (4 pgs.).
Combined Search and Examiner Report dated Feb. 17, 2010 for GB0918575.2 (3 pgs.).
Further Search Report dated Oct. 29, 2010 for GB0918575.2 (1 pg.).
Amended claims of Feb. 7, 2011 for GB0918575.2 (4 pgs.).
Notification of Grant dated Sep. 20, 2011 for GB0918575.2 (2 pgs.).

*Primary Examiner* — Rena L Dye
*Assistant Examiner* — Chaim Smith
(74) *Attorney, Agent, or Firm* — Fitch, Even, Tabin & Flannery LLP

(57) ABSTRACT

A cartridge containing one or more ingredients for the preparation of beverages. The cartridge comprises an inlet for the introduction of an aqueous medium into the cartridge, an outlet for a beverage produced from said one or more beverage ingredients, an aperture in a beverage flow path linking the inlet to the outlet which generates, in use, a jet of beverage, and an expansion chamber located downstream of the aperture. The expansion chamber comprises an expansion chamber inlet for receiving the jet of beverage and an expansion chamber outlet; and an air inlet located in the expansion chamber in the vicinity of the expansion chamber inlet. The cross-sectional area of the expansion chamber decreases in a downstream direction from the expansion chamber inlet to the expansion chamber outlet, and the cross-sectional area and profile of the expansion chamber outlet are substantially the same as the cross-sectional area and profile of the beverage stream as it passes through the outlet.

20 Claims, 7 Drawing Sheets

CARTRIDGE FOR THE PREPARATION OF BEVERAGES

CROSS REFERENCE TO RELATED APPLICATIONS

This application is a U.S. national phase application of International Application No. PCT/GB2010/001953, filed Oct. 20, 2010, which claims benefit from Great Britain Application No. GB0918575.2, filed Oct. 22, 2009, both of which are hereby incorporated herein by reference in their entirety.

FIELD

The present invention relates to a cartridge for the preparation of beverages and which contain one or more ingredients for the preparation of beverages.

BACKGROUND

It is known to use foamed milk in the preparation of beverages such as cappuccino coffee. Traditionally foamed milk has been produced by using a steam wand to direct a steam jet into a reservoir of milk. This is still the primary method of producing foamed milk in a commercial environment. It is desirable to be able to prepare cappuccino-style beverages in the home. However, it is inconvenient to use steam jet equipment in the home since it can be dangerous if not used correctly and can be difficult to clean. This is particularly disadvantageous for equipment used with milk which requires thorough cleaning to prevent contamination.

A cartridge for a domestic beverage machine which is suitable for producing foamed milk is known from EP 1 716 055. Foamed milk is produced within the cartridge by causing air to become entrained in a stream of milk. It is an object of the present invention to provide an improved cartridge for producing foamed beverages, particularly foamed dairy-based beverages.

SUMMARY

Accordingly, the present invention provides a cartridge containing one or more beverage ingredients, said cartridge comprising:

an inlet for the introduction of an aqueous medium into the cartridge;

an outlet for a beverage produced from said one or more beverage ingredients;

an aperture in a beverage flow path linking the inlet to the outlet which generates, in use, a jet of beverage;

an expansion chamber located downstream of the aperture, wherein the expansion chamber comprises an expansion chamber inlet for receiving the jet of beverage and an expansion chamber outlet; and an air inlet located in the expansion chamber in the vicinity of the expansion chamber inlet;

wherein the cross-sectional area of the expansion chamber decreases in a downstream direction from the expansion chamber inlet to the expansion chamber outlet, and the cross-sectional area and profile of the expansion chamber outlet are substantially the same as the cross-sectional area and profile of the beverage stream as it passes through the outlet.

The characteristic shape of the expansion chamber efficiently encourages air to be entrained into the beverage stream as it passes through the expansion chamber The decreased cross-sectional area of the expansion chamber at the expansion chamber outlet helps to prevent beverage being drawn back into the expansion chamber in preference to air, which will reduce the efficiency of the air suction from atmosphere. The improved design results in a greater volume of foamed beverage being produced compared with previously known cartridges.

Preferably the cross-sectional area of the expansion chamber inlet is greater than the cross-sectional area of the jet generating aperture.

In particular, the relatively large cross-sectional area of the expansion chamber in the immediate vicinity of the air inlet provides a relatively large low pressure volume around the incoming jet of beverage thereby allowing the air to relatively easily enter the expansion chamber.

Preferably a floor and a roof of the expansion chamber converge towards one another in the downstream direction.

The expansion chamber may comprise opposing sidewalls and the sidewalls may converge in the downstream direction.

Preferably the aperture is aligned such that the jet of beverage issuing from the aperture passes from the expansion chamber inlet to the expansion chamber outlet substantially without contacting the floor of the expansion chamber.

More preferably the aperture is aligned such that the jet of beverage issuing from the aperture passes from the expansion chamber inlet to the expansion chamber outlet substantially without contacting the one or more sidewalls of the expansion chamber.

Preferably the air inlet is formed in a floor of the expansion chamber.

Preferably the air inlet comprises an elongated slot.

Preferably the elongated slot is aligned perpendicularly to the direction of flow of a jet of beverage issuing from the aperture.

In one preferred aspect the mixing chamber comprises an outlet aperture communicating with the outlet of the cartridge;

the mixing chamber further comprising a plurality of projections located in spaced arrangement around the mixing chamber outlet aperture.

Preferably the projections are arranged around a first portion of a periphery of the mixing chamber outlet aperture and a second portion of the periphery of the mixing chamber outlet aperture is free of the projections, wherein the second portion of the periphery is aligned with the expansion chamber outlet and is sized such that the jet of beverage issuing in use from the expansion chamber outlet is enabled to enter a central region of the mixing chamber without first impacting on the projections.

The projections may be arranged in an arc. Preferably, the projections are arranged in a circular arc.

Preferably the cartridge comprises between 3 and 20 projections.

Preferably the projections act to reduce areas of stagnant flow in use within the mixing chamber. The projections help to eliminate open spaces in which the flow of beverage may become relatively 'stagnant'. It has been found that such 'stagnant' areas allow small air bubbles to coalesce into undesirably larger air bubbles. The projections help to eliminate this problem by breaking up the flow patterns within the mixing chamber to encourage smaller scale turbulent flow patterns which prevent bubble coalescence compared to larger scale eddy patterns which are prone to bubble coalescence. The foam produced is therefore of a better quality than foamed beverage produced from previously known cartridges.

The one or more beverage ingredients may be liquid ingredients. The one or more beverage ingredients may be liquid dairy-based ingredients, such as liquid concentrated milk.

The liquid milk may be pasteurised or sterilised by known methods such as UHT treatment, flash pasteurisation, retorting, etc.

Preferably the cartridge is sealed prior to use in a beverage preparation machine to form a beverage.

The invention further provides a method of making a beverage from a cartridge containing one or more beverage ingredients, the method comprising the steps of:

generating a jet of beverage into an expansion chamber in the cartridge;

entraining air into the jet of beverage as it passes through the expansion chamber;

characterised by the step of substantially matching a cross-sectional area and profile of an outlet of the expansion chamber to the cross-sectional flow area and profile of the beverage stream at the downstream end of the expansion chamber.

The invention further provides a method of making a beverage from such a cartridge, the method comprising the steps of placing the cartridge in a beverage dispensing machine adapted to receive the cartridge and dispensing a beverage therefrom.

The invention still further provides a beverage dispensing system comprising such a cartridge and a beverage dispensing machine adapted to receive the cartridge and to dispense a beverage therefrom.

It will be understood that by the term "cartridge" as used herein is meant a package, container, sachet or receptacle which contains one or more beverage ingredients in the manner described and is suitable for use with a beverage preparation machine. The cartridge may comprise a single component or an equivalent of multiple components, such as a soft pad located in a separate pad holder. Preferably the cartridge is adapted to produce an individual serving of beverage. The cartridge may be rigid, semi-rigid or flexible. The inlet and outlet of the cartridge may be open or require opening in use by, for example, piercing.

In the following description the terms "upper" and "lower" and equivalents will be used to describe the relational positioning of features of the invention. The terms "upper" and "lower" and equivalents should be understood to refer to the cartridge (or other components) in its normal orientation for insertion into a beverage preparation machine and subsequent dispensing as shown, for example, in FIG. 1. In particular, "upper" and "lower" refer, respectively, to relative positions nearer or further from a top surface 11 of the cartridge. In addition, the terms "inner" and "outer" and equivalents will be used to describe the relational positioning of features of the invention. The terms "inner" and "outer" and equivalents should be understood to refer to relative positions in the cartridge (or other components) being, respectively, nearer or further from a centre or major axis of the cartridge 1 (or other component).

BRIEF DESCRIPTION OF THE DRAWINGS

An embodiment of the present invention will now be described, by way of example only, with reference to the accompanying drawings, in which.

DETAILED DESCRIPTION

Figure 1:
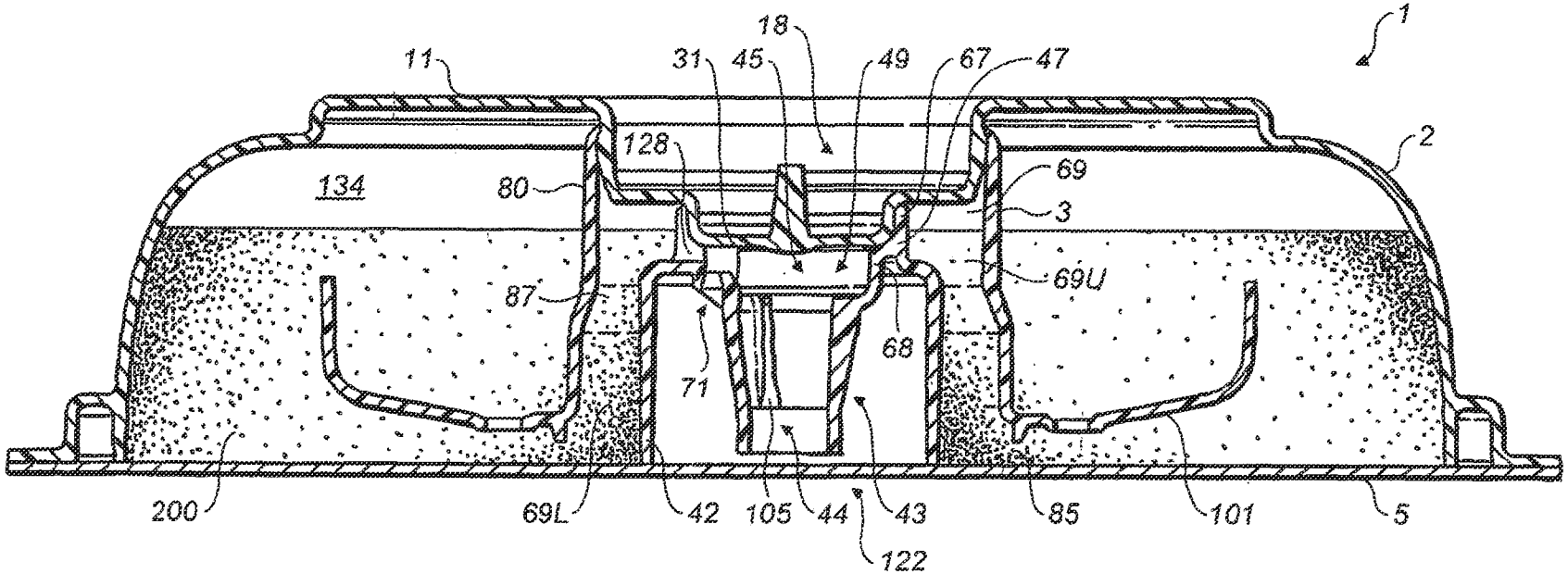
FIG. 1 Prior Art
FIG. 1 is a cross-sectional drawing of a prior art cartridge as taught in EP 1 716 055.

FIG. 1 shows a prior art cartridge 1 as described in the applicant's earlier European patent publication number EP 1 716 055. For a full description of the cartridge 1, the reader is directed to the disclosure of EP 1 716 055 which is incorporated herein by reference. In the following, only those parts of the cartridge 1 which relate to the present invention will be described in detail.

The cartridge 1 of EP 1 716 055 generally comprises an outer member 2, an inner member 3 and a laminate lid 5. The outer member 2, inner member 3 and laminate 5 are assembled to form the cartridge 1 which has a chamber 134 for containing one or more beverage ingredients 200, an inlet (not shown), an outlet 122 and a beverage flow path linking the inlet to the outlet 122.

The inner member 3 comprises a discharge spout 43 surrounded by an outer tube 42 which is connected to the discharge spout 43 by annular flange 47. The inner member 3 also comprises a skirt portion 80 which is connected to the outer tube 42 by skirt ribs 87. An annular channel 69 is defined between the inner wall of the skirt portion 80 and the outer wall of the outer tube 42. The annular channel 69 has a lower portion 69L below the skirt ribs 87 and an upper portion 69U above the skirt ribs 87. Fluid communication between the lower portion 69L and the upper portion 69U of the annular channel 69 is provided by the spaces between the ribs 87. Finally, skirt portion 80 of inner member 3 comprises a bowl 101 for regulating the mixing of the beverage ingredient.

The beverage flow path passes through chamber 134, annular channel 69 and discharge spout 43 as will be described in greater detail below.

The inlet and outlet 122 are initially sealed by the laminate 5 and are opened in use by piercing or cutting of the laminate 5. The beverage flow path is defined by spatial inter-relationships between the outer member 2, inner member 3 and laminate 5. Other components may optionally be included in the cartridge 1, such as a filter.

The various types of cartridge shown in EP 1 716 055 may be used for dispensing roast and ground products or liquid products such as concentrated liquid milk. It is also possible to dispense liquid coffee products.

A particular advantage of the cartridges shown in FIGS. 18 and 34 of EP 1 716 055 is the provision of means for entraining air into the beverage, for example in the form of an eductor. As used herein, the term eductor refers to the use of an aperture, or similar structure, to form a jet of beverage, the aperture being located in the beverage flow path upstream of an air inlet and an expansion chamber, said aperture being arranged to produce a jet of beverage which jets into the expansion chamber to produce a low pressure zone in the vicinity of the air inlet which causes air to be drawn through the air inlet and to become entrained in the beverage stream.

As shown in FIG. 1 (based on FIG. 34 of EP 1 716 055) a rim 67 is provided on the inner member 3 upstanding from annular flange 47 joining outer tube 42 to discharge spout 43. The rim 67 surrounds an inlet 45 to the discharge spout 43. The rim 67 is provided with an inwardly directed shoulder 68. At one point around the circumference of the rim 67 a slot 70 is provided, the slot extending from an upper edge of rim 67 to a point marginally below the level of the shoulder 68.

An air inlet 71 is provided in annular flange 47 circumferentially aligned with the slot 70. The air inlet 71 comprises an aperture passing through the flange 47 so as to provide communication between a point above the flange 47 and the void space below the flange 47 between the outer tube 42 and discharge spout 43. The air inlet 71 comprises an upper frusto-conical portion and a lower cylindrical portion. The wall of the outer tube 42 in the vicinity of the air inlet 71 is shaped to form a chute leading from the air inlet 71 to the inlet 45 of the discharge spout 43.

Three axial ribs 105 are provided on the inner surface of the discharge spout 43 to direct the dispensed beverage downwards towards the outlet 44 to help to confine the dispensed beverage into a relatively narrow, controlled stream.

As shown in FIG. 1, when the cartridge is assembled, a cylindrical extension 18 of the outer member 2 is seated within the rim 67. The cylindrical extension 18 substantially closes off the inlet 45 of the discharge spout 43 including closing off the upper end of the slot 70. Because the slot 70 in the rim 67 extends below the level of the shoulder 68, an aperture 128 remains open to provide a fluid path through the annular flange 47. Thus on assembly, the slot 70 is configured to become an approximately square-shaped aperture 128.

In use, the cartridge 1 is inserted into a beverage preparation machine and the inlet and outlet 122 are opened by piercing members of the beverage preparation machine which perforate and fold back the laminate 5. An aqueous medium, typically water, under pressure enters the cartridge 1 through the inlet and is directed to flow into the chamber 134. The water is forced along the beverage flow path through the chamber 134 and mixes with the beverage ingredients 200 contained therein. The water is at the same time forced upwardly through the beverage ingredients.

The back pressure of beverage collecting in the chamber 134 forces the beverage under pressure through the aperture 128 emerging as a jet into a mixing chamber 49 at the upper end of the discharge spout 43. The jet of beverage passes directly over the air inlet 71. As the beverage enters the chute and inlet 45 of the discharge spout 43 the pressure of the beverage jet drops. As a result air is entrained into the beverage stream in the form of a multitude of small air bubbles as the air is drawn up through the air inlet 71. The jet of beverage issuing from the aperture 128 turbulently flows within the mixing chamber 49 before being funnelled downwards to the outlet spout 44 where the beverage is discharged into a receptacle such as a cup where the air bubbles form the desired frothy appearance.

Figure 2:
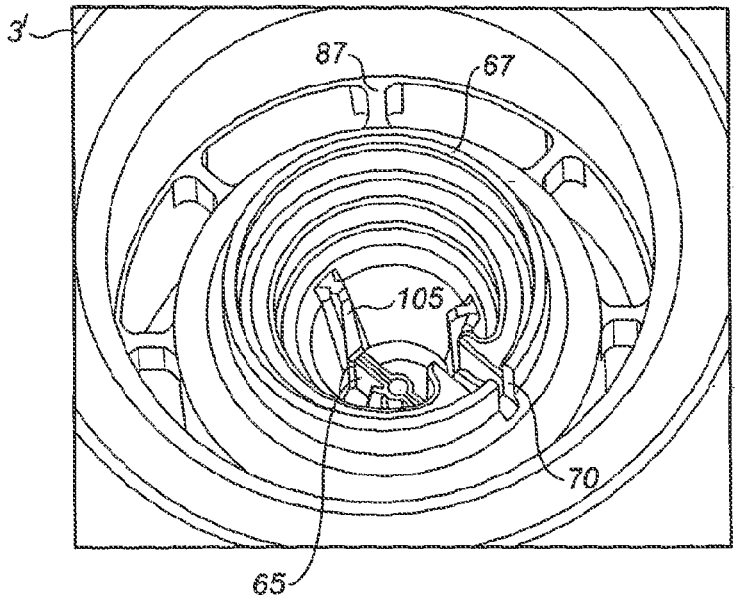
FIG. 2 Prior Art
FIG. 2 is a perspective view of part of an inner member of a cartridge of the type described in EP 1 716 055.
Figure 3:
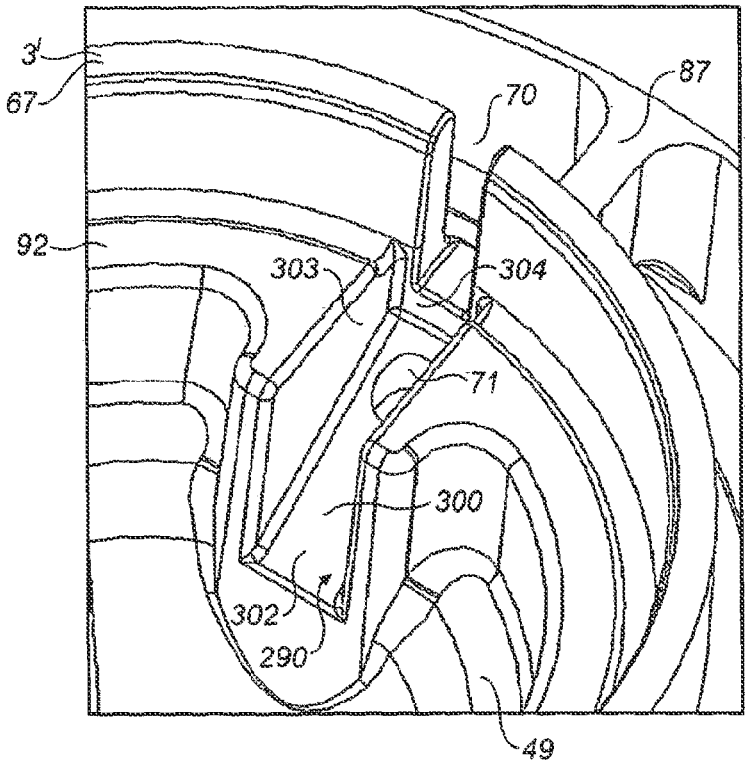
FIG. 3 Prior Art
FIG. 3 is an enlarged perspective view of part of the inner member shown in FIG. 2.

FIGS. 2 and 3 show perspective views of a cartridge having another inner member 3' according to the prior art. Many of the features of the inner member 3' are the same as described above with reference to inner member 3 and like numerals have been used to reference like features.

Inner member 3' differs from inner member 3 in the shape and size of the eductor, and in the addition of partition 65 in the lower portion of the discharge spout 43. The partition 65 helps to prevent the beverage spraying and/or splashing as it exits the discharge spout 43. In addition, inner member 3' has no bowl 101.

As best shown in FIG. 3, the eductor of this cartridge is provided with an elongated chute 300 formed in the inner member 3'. The chute 300 comprises a lower surface 302, side walls 303 and upstream wall 304. The chute 300 further comprises a mouth 290 which is located at the downstream end of the chute 300 and which communicates with the mixing chamber 49. The slot 70 of the eductor is aligned with the chute 300 so that the chute defines a flow path from the aperture 128 (formed from the slot 70 on assembly of the cartridge) to the mixing chamber 49. Air inlet 71 opens into the chute 100 through its lower surface 302 proximate the upstream end of the chute 300.

The cross-sectional area of the chute 300, that is the internal cross-sectional area which is perpendicular to the flow direction and parallel to the upstream wall 304, increases gradually in the downstream direction from the upstream wall 304 to the mouth 290 of the chute 300. Thus, the cross-sectional area of the mouth 290 is greater than the cross-sectional area of the chute 300 in the vicinity of the upstream wall 304 and the air inlet 71. The gradual increase in cross-section of the chute 300 is achieved by the lower surface 302 gradually sloping downwards away from the upstream wall 304. The side walls 303 are substantially parallel such that the width of the chute 300 does not vary along its length. In use, the chute 300 is closed along its top by the lowermost face 31 of the cylindrical extension 18 when the cartridge 1 is assembled. The chute 300 therefore defines an expansion chamber downstream of the aperture 128.

In use, the jet of beverage emerges from the aperture 128 and enters the chute 300. The air inlet 71 is positioned within the chute 300 such that it opens into the low pressure area created by the jet. Because the air inlet 71 is open to atmosphere, air is drawn through the air inlet 71 and becomes entrained in the passing beverage stream. The beverage stream flows along the chute 300 and then on into the mixing chamber 49 where the entrained air and beverage continue to mix until they exit the cartridge via the outlet spout 44.

Prior art cartridges having inner members 3 and 3' as described above have been used successfully in domestic beverage machines to produce foamed beverages such as espresso, cappuccino-style coffee, and foamed dairy-based beverages. In order to further improve the foam quality an improved inner member 3" (described in detail below) has been developed according to the present invention. The improved inner member 3" produces a greater volume of foam having a more consistent distribution of smaller sized bubbles.

Figure 4:
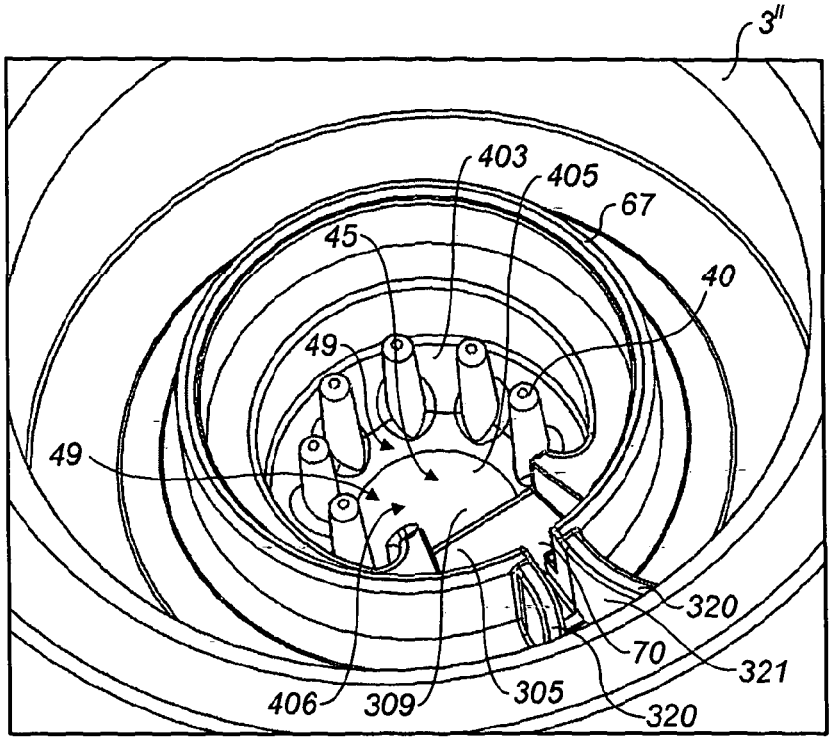
FIG. 4 is a perspective view of part of an inner member which is in accordance with the present invention.
Figure 5:
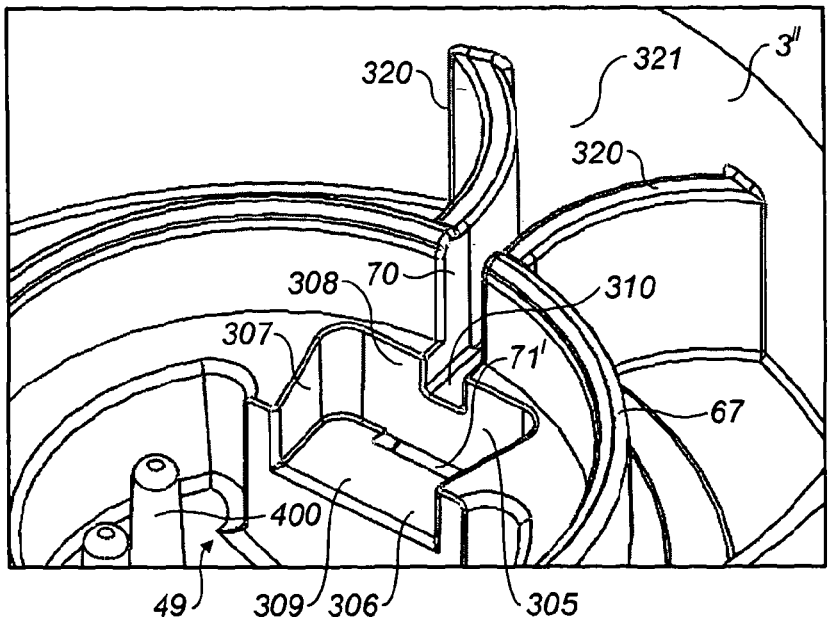
FIG. 5 is an enlarged perspective view of part of the inner member of FIG. 4.

FIGS. 4 and 5 show perspective views of the improved inner member 3" forming part of an improved cartridge in accordance with the present invention. Some of the features of the inner member 3" are the same as described above with reference to inner members 3 and 3' and like numerals have been used to reference like features.

Inner member 3" is similar to inner member 3' discussed above except for the addition of projections 400 in the mixing chamber 49, the (optional) removal of the ribs 105 from the discharge spout 43, and the adaptation of the eductor. In addition, rather than the skirt portion 80 of inner member 3" being connected to the outer tube 42 by skirt ribs 87, the skirt portion 80 of inner member 3" is connected to the outer tube 42 by a skirt shoulder 87'.

Figure 6:
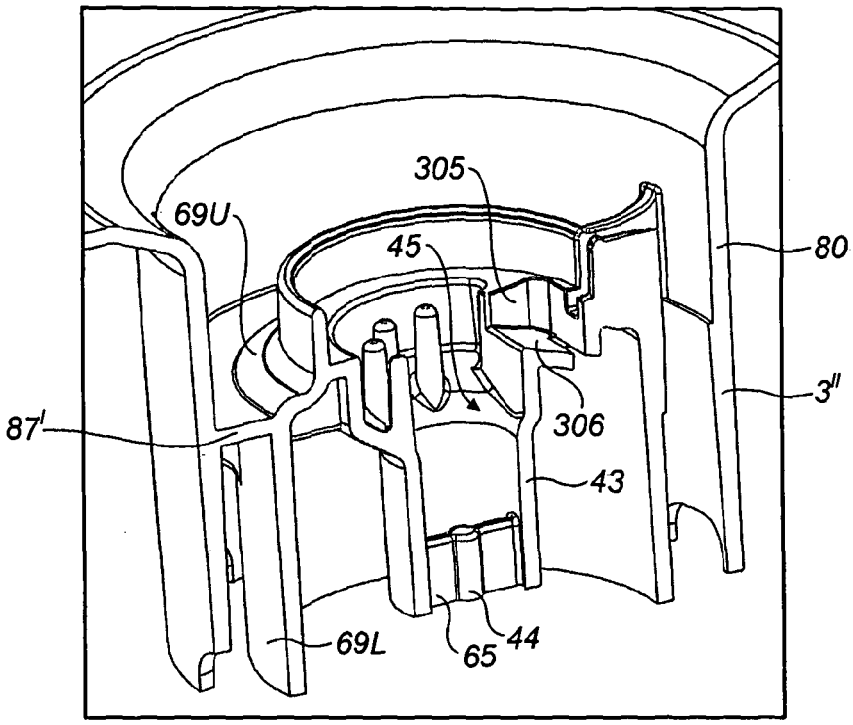
FIG. 6 is a cross-sectional perspective view of a part of the inner member of FIG. 4.
Figure 7:
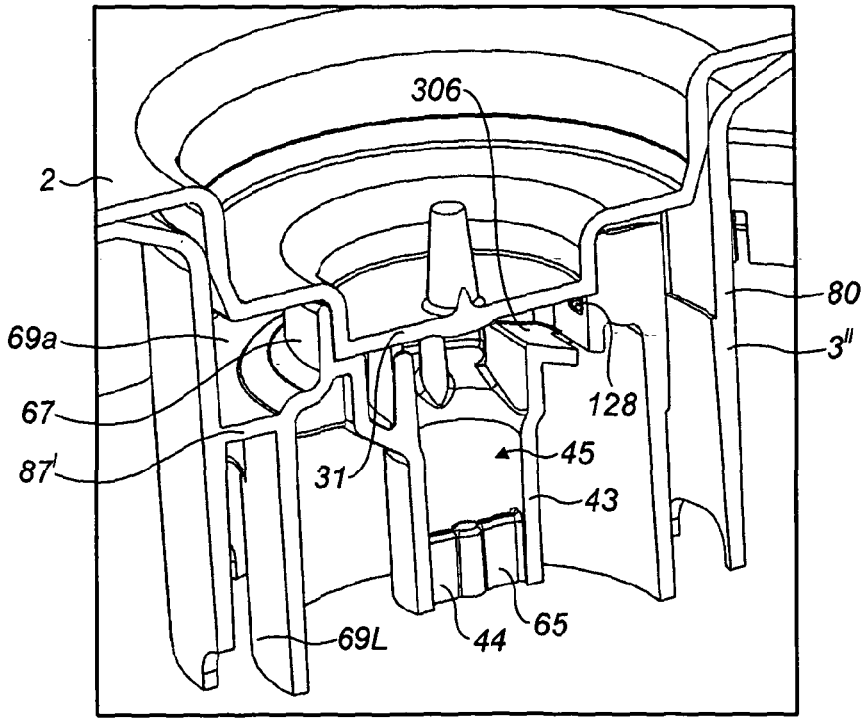
FIG. 7 is a cross-sectional perspective view of a part of the inner member of FIG. 4 with an outer member in place.

As best shown in FIGS. 4 and 6, the skirt shoulder 87' comprises a substantially continuous ring surrounding the outer tube 42. The skirt shoulder 87' has an opening (not shown) which is aligned with slot 70 in the annular rim 67. The opening in the skirt shoulder 87' provides fluid communication between the lower portion 69L of the annular channel 69 and the slot 70. Two flow direction walls 320 are located either side of the opening in the skirt shoulder 87. The flow direction walls 320 extend between the inner wall of the skirt portion 80 and the rim 67 of the outer tube 42 to define a fluted flow direction channel 321. As shown in FIG. 7, in use, the upper portion 69U of the annular channel 69, which includes the flow channel 321, is closed along its top by the lowermost face 31 of the cylindrical extension 18 when the cartridge 1 is assembled.

As best shown in FIG. 5, the slot 70 of inner member 3" communicates with a parallel sided groove 310 which leads into an expansion chamber 305 at an expansion chamber inlet to form an expansion zone. The expansion chamber 305 comprises an upstream wall 308, two side walls 307 and lower surface or floor 306. The expansion chamber 305 further comprises an outlet 309 located at the downstream end of the expansion chamber 105 which communicates with the mixing chamber 49. In use, the expansion chamber 305 is closed along its top by the lowermost face 31 of the cylindrical extension 18 when the cartridge 1 is assembled. The expansion chamber 305 is therefore located downstream of the aperture 128.

The expansion chamber 305 is shaped such that the cross-sectional area, that is the cross-sectional area which is perpendicular to the flow direction and parallel to the upstream wall 308, of the inlet is significantly greater than the cross-sectional area of the jet generating groove 310. Furthermore, the cross-sectional area of the outlet 309 of the expansion chamber 305 is smaller than the cross-sectional area at an inlet of the expansion chamber 305, parallel to the upstream wall 308, in the vicinity of the upstream wall 308 and air inlet 71'. This decrease in cross-sectional area is preferably achieved by the side walls 307 which gradually converge along the length of the chamber 305, such that the width of the chamber 305 decreases along its length, and/or by the lower surface 306 which slopes upwardly from the base of the upstream wall 308 towards the outlet 309 (see FIGS. 6 and 7), such that the height of the chamber 305 gradually decreases along its length.

As shown in FIG. 5, the air inlet is preferably in the form of an elongated slot 71' at the base of the upstream wall 308 of the expansion chamber 305 such that the slot 71' lies at the root of the expansion chamber 305. The slot 71' extends widthways across the expansion chamber 305 but terminates short of both side walls 307 as shown in FIG. 5. The air inlet 71' is located immediately downstream of the upstream wall 308 so that it is as close as possible to the point at which the jet of beverage, which emerges from the aperture 128, enters the expansion chamber 305. This ensures that the air inlet 71' is positioned in the area of lowest pressure in the expansion chamber 305. This helps to optimise the pressure difference across the air inlet 71' and therefore the amount of air drawn through the air inlet 71'. The air inlet 71' may be of any desired shape. However, it has been found that an air inlet in the form of an elongated slot is advantageous as this allows the air inlet to be positioned closer to the upstream end of the expansion chamber 305 than prior art inlets whilst still allowing an air inlet of enlarged size compared to prior art designs. In addition, an elongate slot allows a more robust forming tool to be used in manufacture compared to a mould pin of narrow diameter.

The reduced cross-sectional area of the expansion chamber outlet 309 is formed in a letter-box shape having a relatively large width and small height.

The discharge spout 43 defines an outlet 44 of the cartridge. The inlet 45 to the discharge spout 43 is specifically defined as a centrally located aperture in the floor of the mixing chamber 49. As shown most clearly in FIG. 4, a plurality of projections 400 are provided in the mixing chamber 49 surrounding the inlet 45 of the discharge spout 43. The projections 400 have a shallow frusto-conical shape to facilitate moulding.

The projections 400 are arranged in the mixing chamber 49 such that they surround a first portion 403 of a periphery of the inlet 45 to the discharge spout 43. A second portion of the periphery of the inlet 45 to the discharge spout 43 is free of projections 400 such that the second portion of the periphery defines an inlet zone 405 into an area 406 located substantially within the region bounded by the first portion of the periphery 403. The projections 400 are arranged such that the inlet zone 405 is positioned substantially across the mouth 309 of the expansion chamber 305. Thus, in use, beverage exiting the expansion chamber 305 through mouth 309 is initially unobstructed as it enters the mixing chamber 49.

The projections 400 are arranged in an arc. Preferably the arc is part of a circle. Six projections 400 are provided. The projections 400 project from the floor of the mixing chamber 49 and are free-standing such that they do not contact the roof.

In use, the cartridge is placed in a beverage preparation machine and water is injected into the cartridge as described above. As before a jet of beverage, such as a dairy-based beverage, emerges from the aperture 128 and enters the expansion chamber 305. A low pressure region is produced in the vicinity of the air inlet 71' and this causes air to be drawn through the slot of the air inlet 71' to become entrained in the passing beverage stream.

The configuration of the expansion chamber 305 creates a flow regime within the cartridge which encourages a greater volume of air to become entrained in the beverage stream than with prior art cartridges. Specifically, the expansion chamber 305 is configured such that, in use, a jet of beverage entering the expansion chamber 305, via jet groove 310, encounters a sudden large (in relation to the flow area of the jet) expansion in flow area at the inlet to the expansion chamber 305. As the jet of beverage exits the jet groove 310 it expands in width and depth. The cross-sectional flow area of the beverage stream increases in the downstream direction as it approaches the outlet 309 of the expansion chamber 305. The outlet 309 is sized such that the cross-sectional area and profile of the outlet 309 is substantially matched to the cross-sectional flow area and profile of the beverage stream at the downstream end of the expansion chamber 305 (i.e. at the outlet 309). Furthermore, because the beverage stream has a smaller cross-sectional flow area relative to the cross-sectional area of the expansion chamber 305 than in a prior art system, more of the beverage stream is surrounded by air at least at the upstream end of the expansion chamber 305. More of the available air is therefore able to become entrained in the beverage stream as the air can pass around the whole or majority of the beverage stream's circumference. This effect is enhanced by the shape of the air inlet slot 71' in the form of a slot which places the entire area of the air inlet in the zone of lowest pressure.

This effect is further enhanced by the tendency of a fluid jet to be attracted to the nearest surface (the Coanda effect), namely the lowermost face 31 of the outer member 2 which acts as a roof of the expansion chamber 305 (see FIG. 7). The beverage stream will therefore tend to attach to and spread across, the face 31 as it travels through the expansion chamber 305. This is not possible in the prior art cartridges where the expansion chamber is much narrower and the side walls of the expansion chamber therefore effect the flow dynamics of the beverage stream.

Because the cross-sectional area and profile of the inlet 309 are substantially matched to the cross-sectional flow area and profile of the beverage stream at the inlet 309, air and/or beverage is largely prevented from re-entering the expansion chamber 305 from the mixing chamber 49 by the beverage stream exiting the expansion chamber 305. It has been found with prior art inner members, such as 3' described above, air and/or beverage that can re-enter low-pressure zone near the air inlet from the mixing chamber. This is undesirable since the re-circulating flow can partially block the air inlet preventing efficient air entry. This results in less air being entrained into the issuing jet.

It has been found that the combination of an expansion chamber 305 having an inlet cross-sectional area which is greater than the cross-sectional area of the outlet 309, an outlet 309 the cross-sectional area and profiled which is substantially matched to the flow cross-sectional area and profile of the spray exiting the expansion chamber, and an air inlet 71' being located at the chamber inlet provides a significant improvement in the volume of foamed beverage produced. The cross-sectional area of the inlet 309 is ideally substantially the same as the cross-sectional flow area of the beverage stream since, any larger would allow back flow of beverage from the mixing chamber, and any smaller would result in the beverage stream unduly splashing or impacting on the surfaces of the expansion chamber and flowing back into the expansion chamber.

It is not necessary that the expansion chamber be formed of substantially flat walls as described above in relation to inner member 3". The configuration of the expansion chamber 305 of inner member 3" is particularly suitable for high volume manufacture. However, any geometry having a larger upstream flow area that downstream flow area, and an outlet area which substantially matches the beverage stream flow area at the outlet could be used.

The direction of the jet emerging from the aperture 128 is initially controlled by the parallel sided jet groove 310 such that there is less sensitivity to slight variations in part dimensions or misalignment. However, the groove 310 may be omitted such that the slot 70 communicates directly with the expansion chamber 305 through the upstream wall 308. In addition, the lower surface 306 of the expansion chamber 305 may be substantially perpendicular to the upstream wall 308.

The stream of beverage and entrained air exits the expansion zone 305 via outlet 309 into the mixing chamber 49 where it continues to mix. Because the inlet zone 405 is located across the outlet 309 of the expansion chamber 305, the beverage stream is unobstructed as it passes into the region 406 surrounded by the projections 400.

The projections 400 help to eliminate open spaces within the mixing chamber 49 without creating a large pressure drop. They also encourage more uniform turbulence patterns within the mixing chamber 49 and help to eliminate eddies. This, in turn, helps to prevent small bubbles entrained in the beverage from coalescing to create larger bubbles. The foam produced is therefore of a better quality than foam produced from prior art cartridges, since it has smaller bubbles of a more uniform size.

Figure 8A:
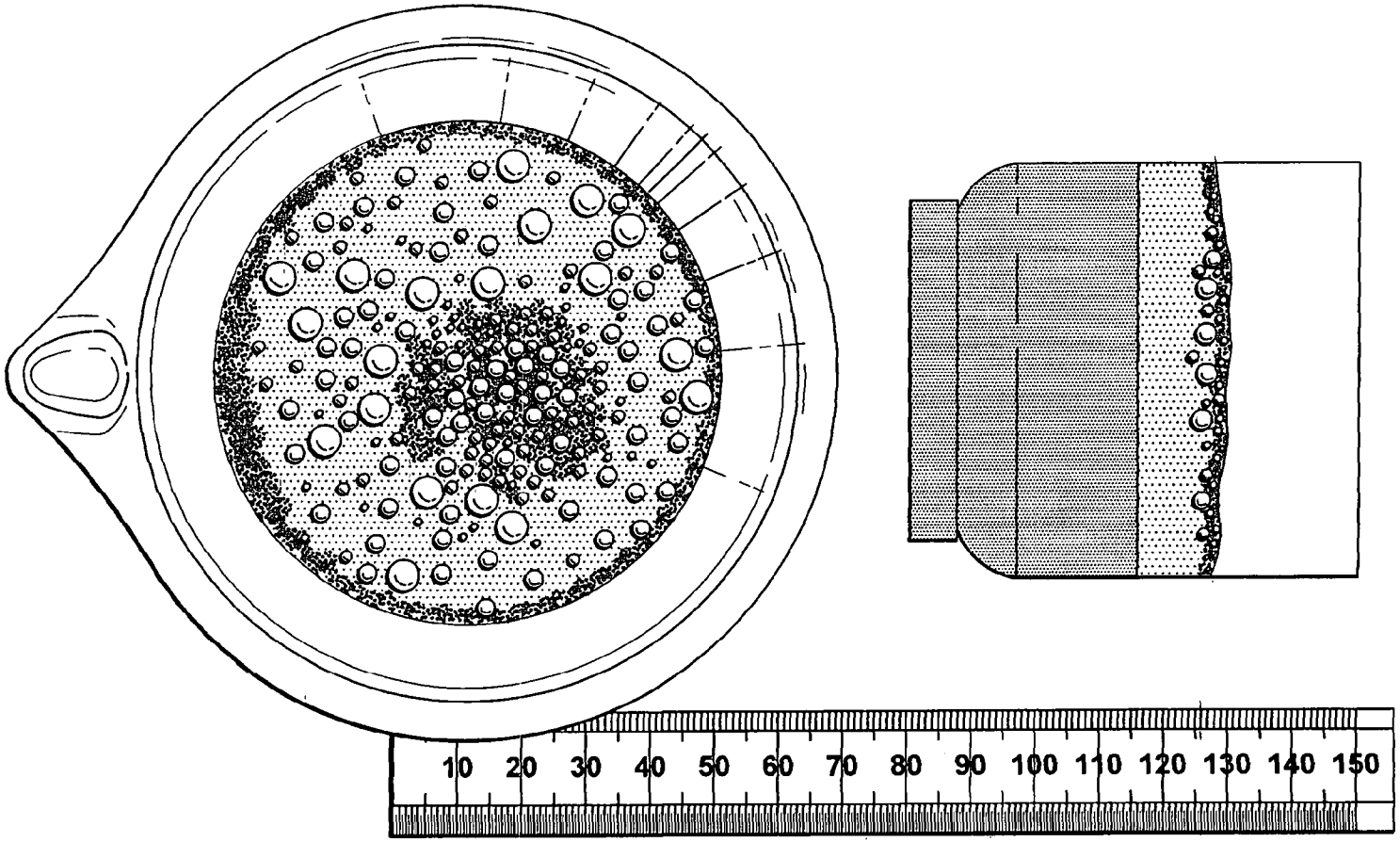
FIGS. 8*a* and 8*b* are plan and side elevations of containers containing beverage showing comparative beverage volumes between a beverage made using a prior art cartridge and a beverage made using a cartridge according to the present invention.
Figure 8B:
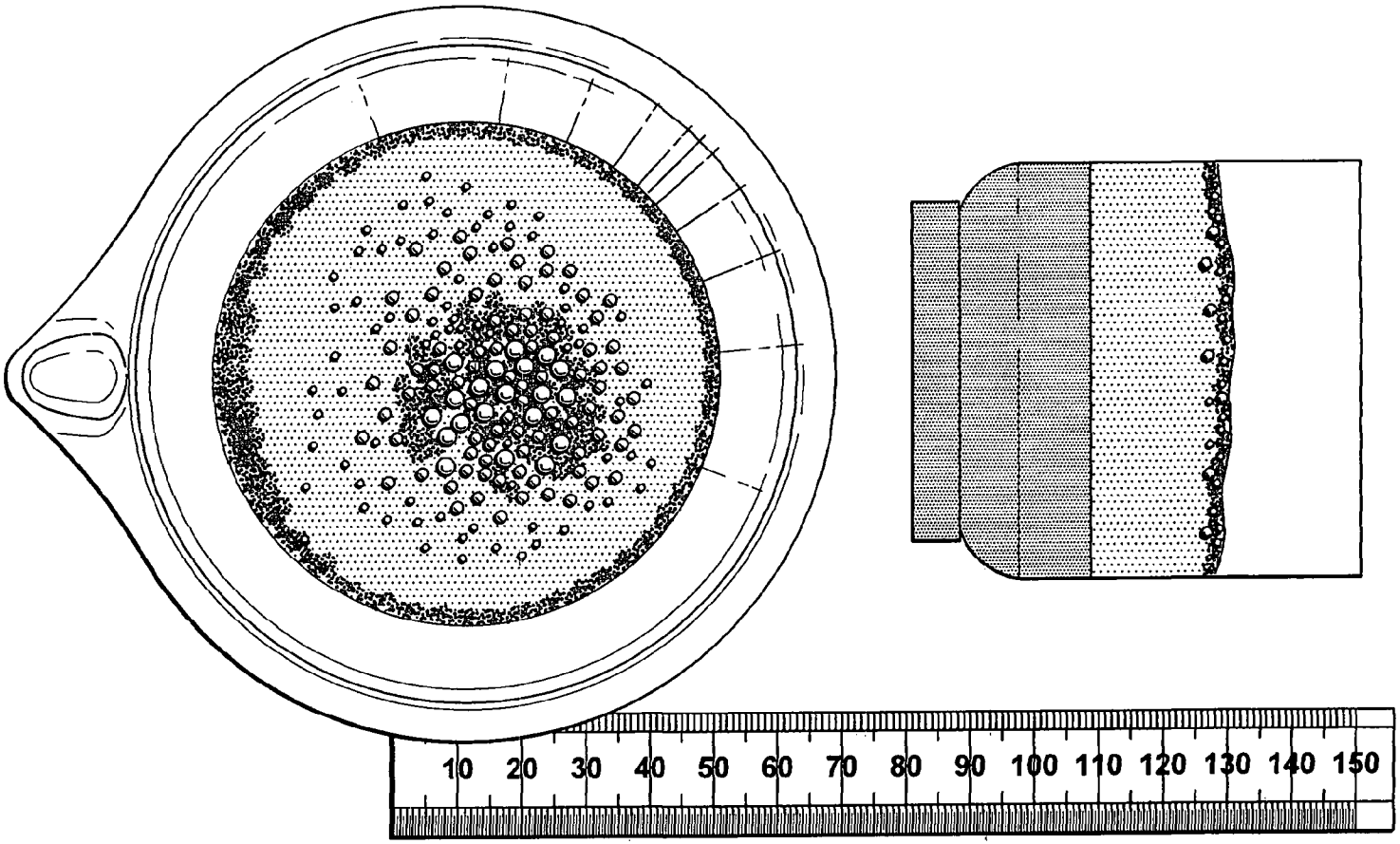
Figure 9A:
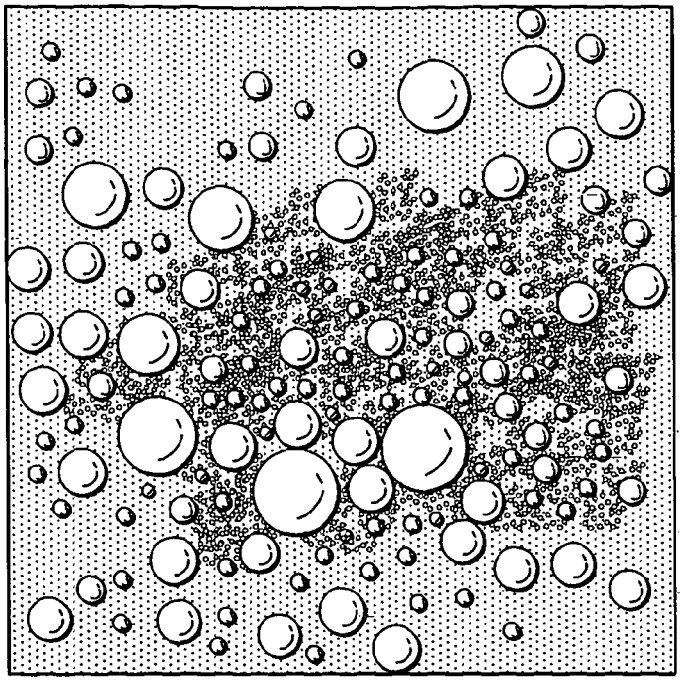
FIGS. 9*a* and 9*b* are plan and side elevations of containers containing beverage showing comparative bubble size variation between a beverage made using a prior art cartridge and a beverage made using a cartridge according to the present invention.
Figure 9B:
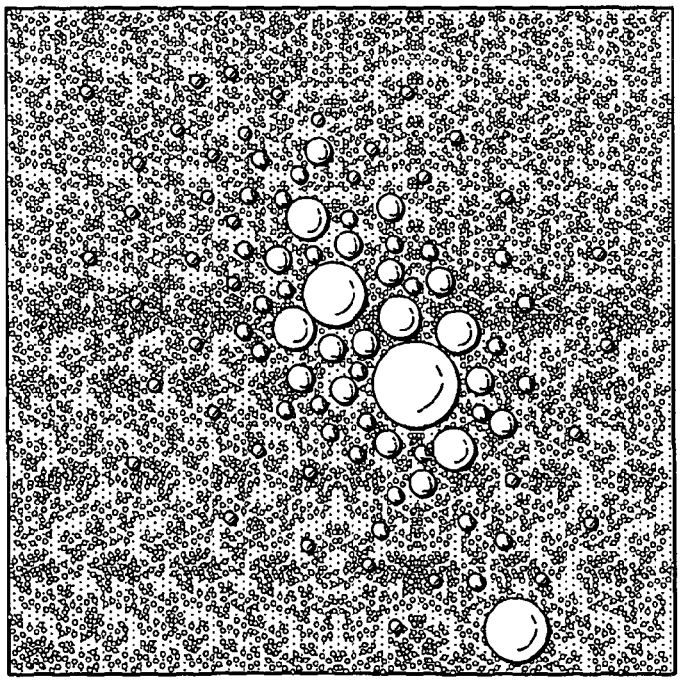

FIGS. 8*a* and 9*a* show drawings of a foamed milk beverage when made with a cartridge having a prior art inner member (such as inner member 3 or 3'), and FIGS. 8*b* and 9*b* show photographs of a foamed milk beverage when made with a cartridge having an inner member according to the present invention. As can be seen from FIGS. 8*a* and 8*b*, the volume of foamed milk beverage made with the cartridge having the prior art inner member (FIG. 8*a*) is considerably less than the volume of foamed milk beverage made using a cartridge having an inner member according to the present invention (FIG. 8*b*). Furthermore, as can be seen from FIGS. 9*a* and 9*b*, the maximum bubble size of the foamed milk beverage made with the cartridge having the prior art inner member (FIG. 9*a*) is considerably greater than the maximum bubble size of the foamed milk beverage made using a cartridge having an inner member according to the present invention (FIG. 9*b*). In addition, the foamed milk beverage made using a cartridge having an inner member according to the present invention has a more consistent bubble size leading to better mouth feel.

The invention has been described above by way of example embodied in a cartridge formed from, amongst other parts, an outer member and an inner member. In particular, the aperture 128 has been described as delimited by portions of the outer and inner members. However, it is to be understood that the invention is also applicable to apertures formed in a single component rather than from the junction of two components. In addition, whilst the described embodiment of cartridge comprises the improved eductor geometry of the present invention and the improved use of obstructions in the mixing chamber it should be understood that the improved eductor geometry can be utilised in a cartridge according to the present invention without the presence of the improved obstructions and vice versa.

The invention claimed is:

1. A cartridge containing one or more beverage ingredients, said cartridge comprising:

an inlet for the introduction of an aqueous medium into the cartridge;

an outlet for a beverage produced from said one or more beverage ingredients;

an aperture in a beverage flow path linking the inlet to the outlet which generates, in use, a jet of beverage;

an expansion chamber located downstream of the aperture, wherein the expansion chamber comprises an expansion chamber inlet in an upstream wall for receiving the jet of beverage and an expansion chamber outlet; and an air inlet located in the expansion chamber in the vicinity of the expansion chamber inlet;

wherein the expansion chamber has a cross-sectional area which is perpendicular to the direction of flow of the jet of beverage and parallel to the upstream wall, and said cross-sectional area decreases in a downstream direction from the expansion chamber inlet to the expansion chamber outlet, and the cross-sectional area and profile of the expansion chamber outlet are sized to be substantially the same as the cross-sectional area and profile of the beverage stream as it passes through the outlet.

2. A cartridge as claimed in claim 1 wherein the cross-sectional area of the expansion chamber inlet is greater than the cross-sectional area of the jet generating aperture.

3. A cartridge as claimed in claim 2 wherein a floor and a roof of the expansion chamber converge towards one another in the downstream direction.

4. A cartridge as claimed in claim 1 wherein the expansion chamber comprises opposing sidewalls and the sidewalls converge in the downstream direction.

5. A cartridge as claimed in claim 3 wherein the aperture is aligned such that the jet of beverage issuing from the aperture passes from the expansion chamber inlet to the expansion chamber outlet substantially without contacting the floor of the expansion chamber.

6. A cartridge as claimed in claim 4 wherein the aperture is aligned such that the jet of beverage issuing from the aperture passes from the expansion chamber inlet to the expansion chamber outlet substantially without contacting the one or more sidewalls of the expansion chamber.

7. A cartridge as claimed in claim 1 wherein the air inlet is formed in a floor of the expansion chamber.

8. A cartridge as claimed in claim 1 wherein the air inlet comprises an elongated slot.

9. A cartridge as claimed in claim 8 wherein the elongated slot is aligned perpendicularly to the direction of flow of a jet of beverage issuing from the aperture.

10. A cartridge as claimed in claim 1 further comprising a mixing chamber having an outlet aperture communicating with the outlet of the cartridge;

the mixing chamber further comprising a plurality of projections located in spaced arrangement around the mixing chamber outlet aperture.

11. A cartridge as claimed in claim 10 wherein the projections are arranged around a first portion of a periphery of the mixing chamber outlet aperture and a second portion of the periphery of the mixing chamber outlet aperture is free of the projections, wherein the second portion of the periphery is aligned with the expansion chamber outlet and is sized such that a stream of beverage issuing, in use, from the expansion chamber outlet is enabled to enter a central region of the mixing chamber without first impacting on the projections.

12. A cartridge as claimed in claim 11 wherein the projections are arranged in an arc.

13. A cartridge as claimed in claim 12 wherein the projections are arranged in a circular arc.

14. A cartridge as claimed in claim 10 comprising between 3 and 20 projections.

15. A cartridge as claimed in claim 10 wherein the projections act to reduce areas of stagnant flow in use within the mixing chamber.

16. A cartridge as claimed in claim 1 wherein the one or more beverage ingredients are liquid ingredients.

17. A cartridge as claimed in claim 16 wherein the one or more beverage ingredients are liquid dairy-based ingredients.

18. A cartridge as claimed in claim 1 which is sealed prior to use in a beverage preparation machine to form a beverage.

19. A method of making a beverage from a cartridge containing one or more beverage ingredients as claimed in claim 1, the method comprising the steps of:

generating a jet of beverage into an expansion chamber in the cartridge; and entraining air into the jet of beverage as it passes through the expansion chamber.

20. A method of making a beverage from a cartridge as claimed in claim 19, the method comprising the steps of placing the cartridge in a beverage dispensing machine adapted to receive the cartridge and dispensing a beverage therefrom.

* * * * *